US008251506B2

(12) United States Patent
Kato et al.

(10) Patent No.: US 8,251,506 B2
(45) Date of Patent: Aug. 28, 2012

(54) INK-JET RECORDING APPARATUS

(75) Inventors: Shigeki Kato, Toyoake (JP); Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 245 days.

(21) Appl. No.: 12/710,347

(22) Filed: Feb. 22, 2010

(65) Prior Publication Data

US 2010/0225689 A1 Sep. 9, 2010

(30) Foreign Application Priority Data

Mar. 9, 2009 (JP) ..... 2009-054399

(51) Int. Cl.
*B41J 2/01* (2006.01)

(52) U.S. Cl. ..... 347/104

(58) Field of Classification Search ..... 347/5, 9–11, 347/101, 104
See application file for complete search history.

(56) References Cited

U.S. PATENT DOCUMENTS

| | | | |
|---|---|---|---|
| 5,316,282 | A | 5/1994 | Fukube et al. |
| 5,531,436 | A | 7/1996 | Ohyama et al. |
| 6,309,064 | B1 | 10/2001 | Tanno et al. |
| 2002/0009319 | A1 | 1/2002 | Tanno et al. |
| 2003/0063174 | A1 | 4/2003 | Kanome |
| 2005/0195264 | A1 | 9/2005 | Sootome et al. |

FOREIGN PATENT DOCUMENTS

| | | | |
|---|---|---|---|
| EP | 0693381 | A1 | 1/1996 |
| JP | H05-008466 | A | 1/1993 |
| JP | 2804715 | B2 | 12/1995 |
| JP | H11-151822 | A | 6/1996 |
| JP | H10-250166 | A | 9/1998 |
| JP | H11-151842 | A | 6/1999 |
| JP | 2004-131197 | A | 4/2004 |
| JP | 2004-137016 | A | 5/2004 |
| JP | 2006-027771 | A | 2/2006 |
| JP | 2009-023773 | A | 2/2009 |

OTHER PUBLICATIONS

The State Intellectual Property Office of the People's Republic of China, Notification of First Office Action for Chinese Patent Application No. 201010126603.8 (counterpart to above-captioned patent application), issued May 25, 2011.

Japan Patent Office, Notification of Reasons for Refusal in Japanese Patent Application No. 2009-054399 (counterpart to above-captioned patent application), dispatched Mar. 15, 2011.

(Continued)

*Primary Examiner* — An Do
(74) *Attorney, Agent, or Firm* — Baker Botts L.L.P.

(57) ABSTRACT

An ink-jet recording apparatus, including: an ink-jet head having an ejection surface; a conveyor mechanism having a conveyor belt with a conveyor surface and a belt drive mechanism for moving the conveyor belt and configured to convey a recording medium; a pair of comb electrodes disposed so as to be opposed to the ejection surface, each comb electrode including a plurality of electrode portions, the electrode portions of one and the other of the comb electrodes being alternately arranged; a voltage-application power source for applying a voltage between the comb electrodes; and a controller having an attraction control portion for controlling the power source so as to attract the medium to the conveyor surface, wherein the attraction control portion is configured to control the power source such that the voltage is applied between the comb electrodes after initiation of the movement of the conveyor belt by the belt drive mechanism.

7 Claims, 10 Drawing Sheets

OTHER PUBLICATIONS

European Patent Office; Extended Search Report in European Patent Application No. 10152560.8 (counterpart to the above-captioned U.S. patent application) mailed Apr. 16, 2010.

The State Intellectual Property Office of the People's Republic of China, Notification of Second Office Action for Chinese Patent Application No. 201010126603.8 (counterpart to above-captioned patent application), issued Mar. 30, 2012.

INK-JET RECORDING APPARATUS

The present application claims priority from Japanese Patent Application No. 2009-054399, which was filed on Mar. 9, 2009, the disclosure of which is herein incorporated by reference in its entirety.

BACKGROUND OF THE INVENTION

1. Field of the Invention

The present invention relates to an ink-jet recording apparatus configured to conduct recording on a recording medium.

2. Discussion of Related Art

An ink-jet recording apparatus includes a conveyor belt for conveying a recording medium such as a paper sheet and an ink-jet head for ejecting ink onto the recording medium conveyed by the conveyor belt. When the recording medium is conveyed between the conveyor belt and the ink-jet head, the recording medium is attracted to the conveyor belt for preventing conveyance failure due to contact of the recording medium with the ink-jet head, for instance.

There is disclosed a recording apparatus in which the recording medium is electrostatically attracted to an endless belt by applying a voltage to comb electrodes disposed on the inner surface of the conveyor belt.

SUMMARY OF THE INVENTION

However, where the conveyor belt starts moving or rotating with the recording medium electrostatically attracted or adhering to the conveyor belt, a motor that moves or rotates the conveyor belt undergoes a load due to the attractive force, undesirably causing various problems such as a loss of synchronization of the motor, a slippage of the conveyor belt, and a breakage of the conveyor belt.

It is therefore an object of the invention to provide an ink-jet recording apparatus capable of reducing a load to be applied to the conveyor belt when the conveyor belt starts moving or rotating.

The above-indicated object may be attained according to a principle of the invention, which provides an ink-jet recording apparatus, comprising:

an ink-jet head in which is formed an ejection surface through which ink is ejected;

a conveyor mechanism which includes: a conveyor belt having a conveyor surface that is opposed the ejection surface; and a belt drive mechanism configured to move the conveyor belt and which is configured to convey a recording medium on the conveyor surface in a medium conveyance direction in which the recording medium is conveyed;

a pair of comb electrodes which are disposed so as to be opposed to the ejection surface with the conveyor surface interposed therebetween, each of the comb electrodes including a plurality of electrode portions that are arranged in a direction perpendicular to a direction in which the comb electrodes are opposed to the ejection surface, each of the plurality of electrode portions of one of the comb electrodes and each of the plurality of electrode portions of the other of the comb electrodes being alternately arranged in the direction in which the plurality of electrode portions of each of the comb electrodes are arranged;

a voltage-application power source configured to apply a voltage between the pair of comb electrodes; and a controller which has an attraction control portion configured to control the voltage-application power source so as to attract the recording medium to the conveyor surface and which controls operations of the ink-jet recording apparatus, wherein the attraction control portion is configured to control the voltage-application power source such that the voltage is applied between the pair of comb electrodes after initiation of the movement of the conveyor belt by the belt drive mechanism.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

There will be hereinafter described a preferred embodiment of the invention with reference to the drawings.

<Mechanical Structure of Ink-Jet Printer>

Figure 1:
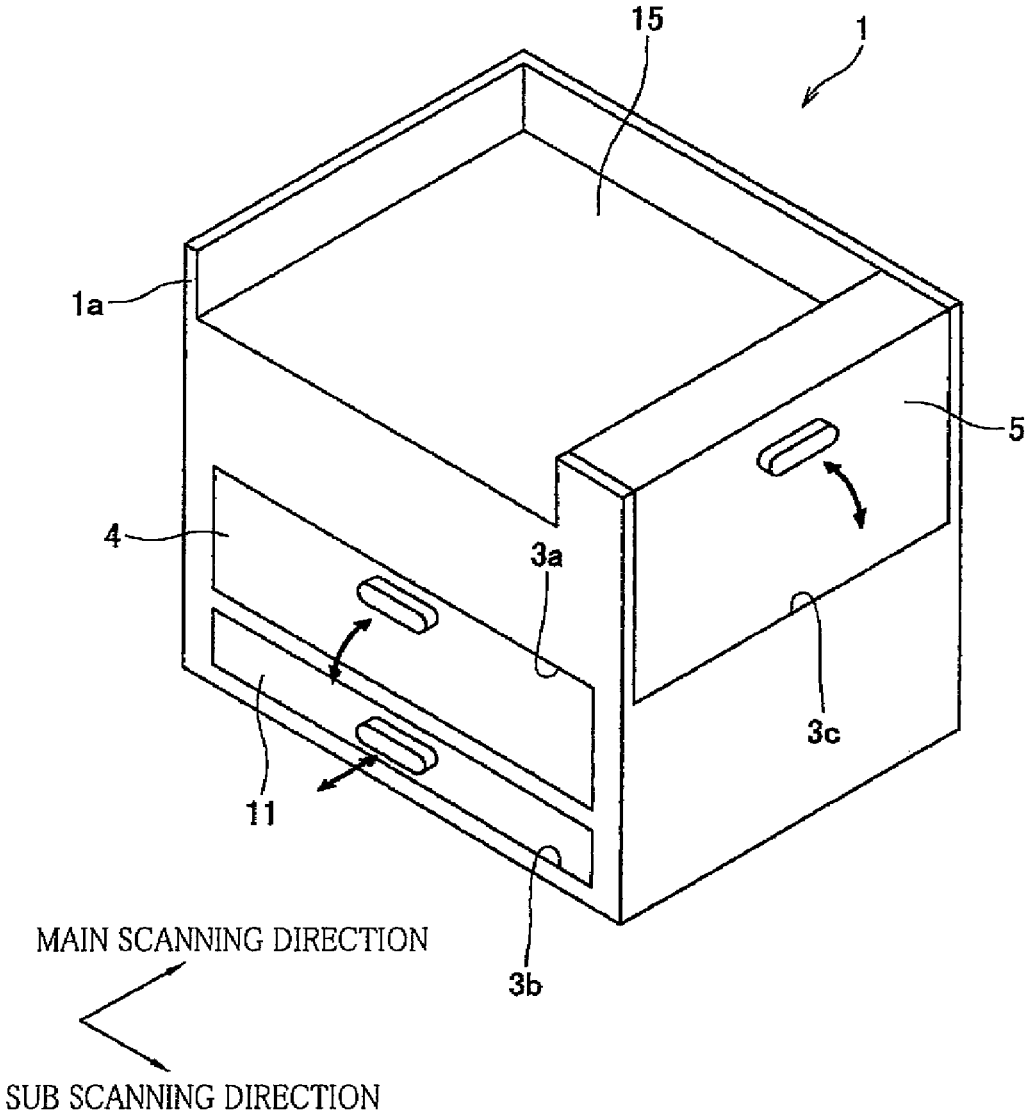
FIG. 1 is a perspective external view of an ink-jet printer according to one embodiment of the invention.

As shown in the perspective view of FIG. 1, an ink-jet printer 1 as an ink-jet recording apparatus according to one embodiment of the invention has a casing 1*a* which is a rectangular parallelepiped and which has two openings, i.e., upper and lower openings 3*a*, 3*b*, that are formed on the front of the casing 1*a* (on the front surface of the casing 1*a* in FIG. 1). In the opening 3*a*, a first door 4 is provided so as to be openable and closable about a horizontal axis located at the lower end of the opening 3*a*. The opening 3*a* and the first door 4 are disposed so as to be opposed to a conveyor mechanism 50 (a conveyor portion) in a depth direction of the casing 1*a*, namely, in a direction perpendicular to the sheet plane of FIG. 2, i.e., in a main scanning direction. The arrangement allows a user easy access to the conveyor mechanism 50 by opening the first door 4 in an instance where a sheet P (as a recording medium) is jammed at the conveyor mechanism 50, so that the jammed sheet P can be removed.

Figure 2:
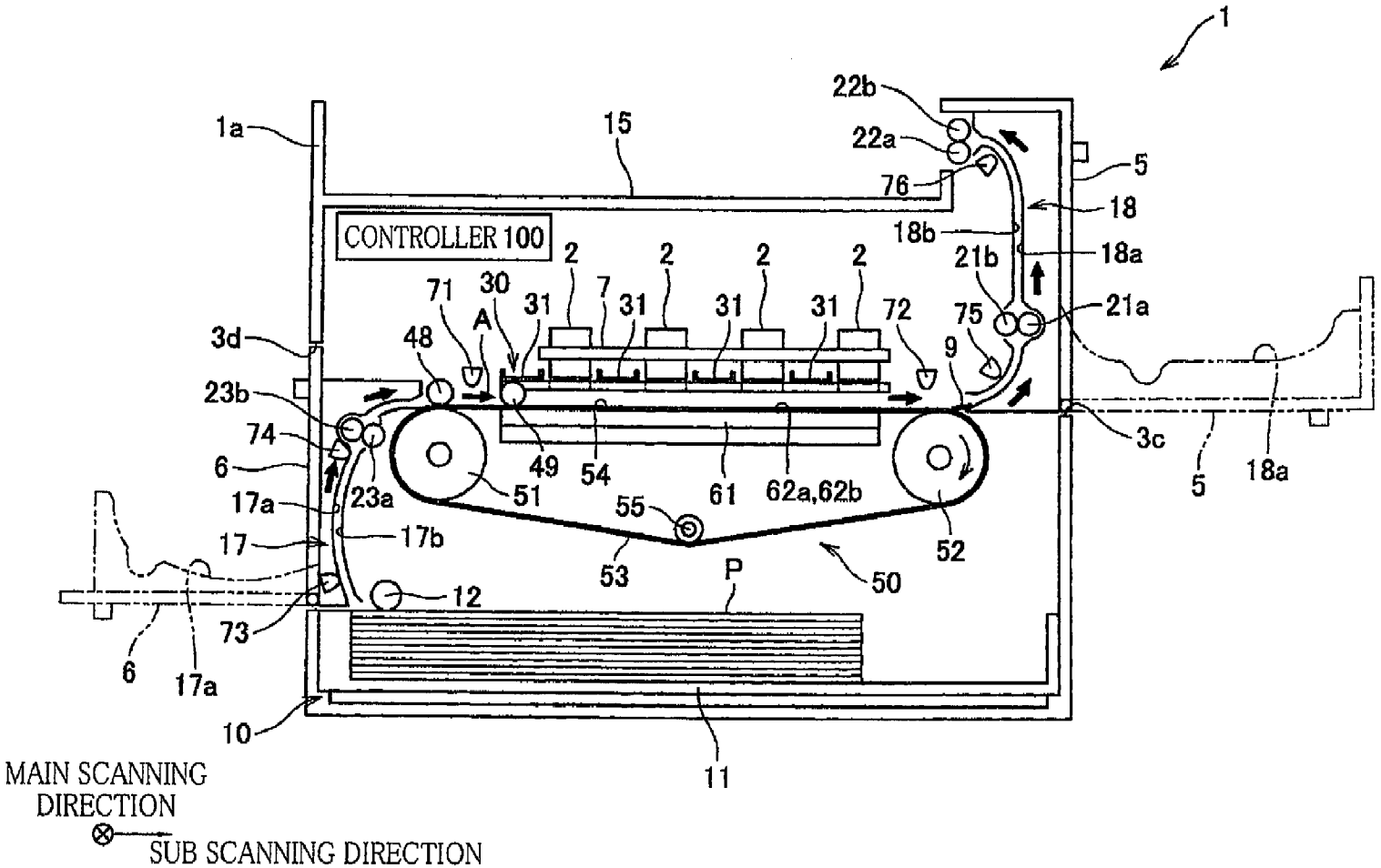
FIG. 2 is a schematic view showing an internal structure of the ink-jet printer of FIG. 1.

As shown in FIG. 1, an opening 3*c* is formed on one side surface of the casing 1*a* (on the right side surface of the casing 1*a* in FIG. 1). In the opening 3*c*, a third door 5 is provided so as to be openable and closable about a horizontal axis located at the lower end of the opening 3*c*. As shown in FIG. 2, on the inner side of the third door 5, an outer guide surface 18*a* that partially constitutes a sheet discharge guide 18 (which will be described) is formed. The opening 3*c* and the third door 5 are disposed so as to be opposed to an inside of the sheet discharge guide 18 in a sub scanning direction that is perpendicular to the main scanning direction. In this structure, where the sheet P is jammed in the sheet discharge guide 18, the user can access the inside of the sheet discharge guide 18 by opening the third door 5, so that the jammed sheet P can be removed.

An opening 3*d* (not shown) is formed on another side surface of the casing 1*a* (on the left side surface of the casing 1*a* in FIG. 1). In the opening 3*d*, a second door 6 is provided so as to be openable and closable about a horizontal axis located at the lower end of the opening 3*d*. As shown in FIG. 2, on the inner side of the second door 6, an outer guide surface 17*a* that partially constitutes a sheet supply guide 17 (which will be described) is formed. The opening 3*d* and the second door 6 are disposed so as to be opposed to an inside of the sheet supply guide 17 in the sub scanning direction. In this structure, where the sheet P is jammed in the sheet supply guide 17, the user can access the inside of the sheet supply guide 17 by opening the second door 6, so that the jammed sheet P can be removed.

The ink-jet printer 1 is a color ink-jet printer having four ink-jet heads 2 which respectively eject inks of different colors, i.e., magenta, cyan, yellow, and black. The ink-jet printer 1 has a sheet supply device 10 at its lower portion and a discharged-sheet receiving portion 15 at its upper portion. The conveyor mechanism 50 for conveying the sheet P in a sheet conveyance direction "A" shown in FIG. 2 (as a medium conveyance direction) is disposed between the sheet supply device 10 and the discharged-sheet receiving portion 15. The ink-jet printer 1 further has a controller 100 for controlling operations thereof.

Each of the four ink-jet heads 2 has a generally rectangular parallelepiped shape that is long in the main scanning direction. The four ink-jet heads 2 are disposed so as to be spaced apart from each other in the sub scanning direction and are fixed to a frame 7. That is, the ink-jet printer 1 is a line-type printer. In the present embodiment, the sub scanning direction is a direction parallel to the sheet conveyance direction A while the main scanning direction is a direction perpendicular to the sub scanning direction and is horizontal, namely, the main scanning direction coincides with the vertical direction in FIG. 3.

Each ink-jet head 2 has a laminar body having: a flow-passage unit in which are formed ink passages that include pressure chambers; and an actuator for giving pressure to ink in the pressure chambers. The flow-passage unit and the actuator (both not shown) are bonded to each other so as to provide the laminar body. The bottom surface of each ink-jet head 2 is formed as an ejection surface 2*a* from which the ink is ejected. The ejection surface 2*a* is formed with a plurality of ejection openings from which the ink is ejected.

As shown in FIG. 2, the sheet supply device 10 includes a sheet cassette 11 in which a stack of sheets P can be accommodated, a sheet supply roller 12 configured to supply an uppermost one of the sheets P from the sheet cassette 11, and a sheet supply motor (not shown) configured to rotate the sheet supply roller 12. The sheet cassette 11 is disposed so as to be attachable to and detachable from the casing 1*a* in a direction perpendicular to the sheet plane of FIG. 2. In a state in which the sheet cassette 11 is installed on the casing 1*a*, the sheet cassette 11 overlaps the conveyor mechanism 50 when viewed from the top of the printer 1. The sheet supply roller 12 is configured to supply the uppermost one of the sheets P from the sheet cassette 11 while being held in rolling contact therewith. The sheet supply motor configured to rotate the sheet supply roller 12 is controlled by the controller 100.

At the left-side portion of the ink-jet printer 1 as seen in FIG. 2, namely, at a portion of a sheet transfer path between the sheet cassette 11 and the conveyor mechanism 50, there are disposed: the sheet supply guide 17 which extends in a curved form from the sheet cassette 11 toward the conveyor mechanism 50; and two feed rollers 23*a*, 23*b* provided on the downstream side of the sheet supply guide 17. The sheet supply guide 17 is constituted by the outer guide surface 17*a* formed on the second door 6 and an inner guide surface 17*b* opposed to the outer guide surface 17*a*. The feed roller 23*b* is rotatably driven by a feed motor (not shown) controlled by the controller 100 while the feed roller 23*a* is a driven roller configured to be rotated as the sheet is transferred.

In the structure described above, the sheet supply roller 12 is rotated clockwise in FIG. 2 by being controlled by the controller 100, whereby the sheet P contacting the sheet supply roller 12 is transferred upward in FIG. 2 through the sheet supply guide 17. The sheet P is supplied to the conveyor mechanism 50 while being held by the feed rollers 23*a*, 23*b*.

A sensor 73 is disposed at a position which is downstream of the sheet supply roller 12 and is upstream of the sheet supply guide 17 while a sensor 74 is disposed at a position which is downstream of the sheet supply guide 17 and is upstream of the feed rollers 23*a*, 23*b*. Each of the sensors 73, 74 is disposed such that its detecting surface is opposed to the sheet P passing through the sheet supply guide 17. Each sensor 73, 74 is an optical sensor of reflection type configured to detect the sheet P by sensing a light reflected on the surface of the sheet P. The two sensors 73, 74 are disposed at the respective positions at which the two sensors 73, 74 are opposed to the inner central portion of the sheet supply guide 17 in the main scanning direction. These two sensors 73, 74 are configured to detect the leading end and the trailing end of the sheet P passing through the sheet supply guide 17. It is noted that each sensor 73, 74 is not limited to the optical sensor of reflection type, but may be an optical sensor of transmission type.

In an instance where the sensor 74 does not detect the leading end of the sheet P even though a prescribed time has been passed after detection of the leading end of the sheet P by the sensor 73, the controller 100 judges that a jam of the sheet P (so-called paper jam) has occurred in the sheet supply guide 17. In this instance, the controller 100 stops rotation of the sheet supply roller 12 and the feed roller 23*b*.

As shown in FIG. 2, the conveyor mechanism 50 includes two belt rollers 51, 52, an endless conveyor belt 53 wound around the two belt rollers 51, 52 so as to be stretched therebetween, a tension roller 55 configured to give tension to the conveyor belt 53, a conveyance motor (not shown) configured to rotate the belt roller 52, and a platen 61 having a generally parallelepiped shape. The two belt rollers 51, 52 are arranged in the sheet conveyance direction A. The conveyor belt 53 has an outer circumferential surface functioning as a conveyor surface 54 on which the sheet P is held or supported. The two belt rollers 51, 52 and the conveyance motor constitute a belt drive mechanism for moving or rotating the conveyor belt 53. That is, the conveyor mechanism 50 is constituted by the conveyor belt 53 and the belt drive mechanism.

The belt roller 52 is a drive roller and is configured to be rotated clockwise in FIG. 2 by a conveyance motor (not shown). The belt roller 51 is a driven roller configured to be rotated clockwise in FIG. 2 by the movement of the conveyor belt 53 in accordance with the rotation of the belt roller 52. As shown in FIG. 2, the tension roller 55 is rotatably supported by the casing 1*a* so as to give tension to the conveyor belt 53 while contacting the inner circumferential surface of the conveyor belt 53 at the lower portion of the loop of the same 53. The tension roller 55 is configured to be rotated clockwise in FIG. 2 by the movement of the conveyor belt 53. The platen 61 has a dimension as measured in the main scanning direction that is slightly larger than those of the sheet P and the conveyor belt 53 as measured in the same direction.

As shown in FIG. 2, the upper surface of the platen 61 is held in contact with the inner circumferential surface of the conveyor belt 53 at the upper portion of the loop of the belt 53 so as to support the belt 53 from the inside of the loop. According to the arrangement, the conveyor belt 53 at the upper portion of the loop and the ejection surfaces 2*a* of the ink-jet heads 2 are opposed to each other so as to be parallel to each other, and there is formed a slight clearance between the ejection surfaces 2*a* of the ink-jet heads 2 and the conveyor surface 54 of the conveyor belt 53. The clearance partially constitutes the sheet transfer path.

A pressing roller 48 is disposed on the upstream side of one of the four ink-jet heads 2 that is located on the most upstream side in the sheet conveyance direction A among the four ink-jet heads 2, so as to be opposed to the belt roller 51 with the conveyor belt 53 interposed therebetween. The pressing roller 48 is biased toward the conveyor surface 54 by an elastic member such as a spring (not shown) and is configured to press the sheet P supplied from the sheet supply device 10 onto the conveyor surface 54. The pressing roller 48 is a driven roller configured to be rotated in accordance with the rotary movement of the conveyor belt 53.

A pressing roller 49 formed of a resin is disposed at a position which is upstream of the most upstream ink-jet head 2 and is downstream of the pressing roller 48, in the sheet conveyance direction A, and at which the pressing roller 49 is opposed to the platen 61. The pressing roller 49 is biased toward the conveyor surface 54 by an elastic member such as a spring (not shown) and is configured to press the sheet P onto a prescribed portion of the conveyor surface 54 at which the pressing roller 49 is opposed to the conveyor surface 54, whereby the sheet P is pressed indirectly onto the platen 61. According to the arrangement, the sheet P is electrostatically attracted, with ease, to the conveyor surface 54 by a pair of comb electrodes 62*a*, 62*b* that will be described below. The pressing roller 49 is a driven roller configured to be rotated in accordance with the rotary movement of the conveyor belt 53.

Figure 3:
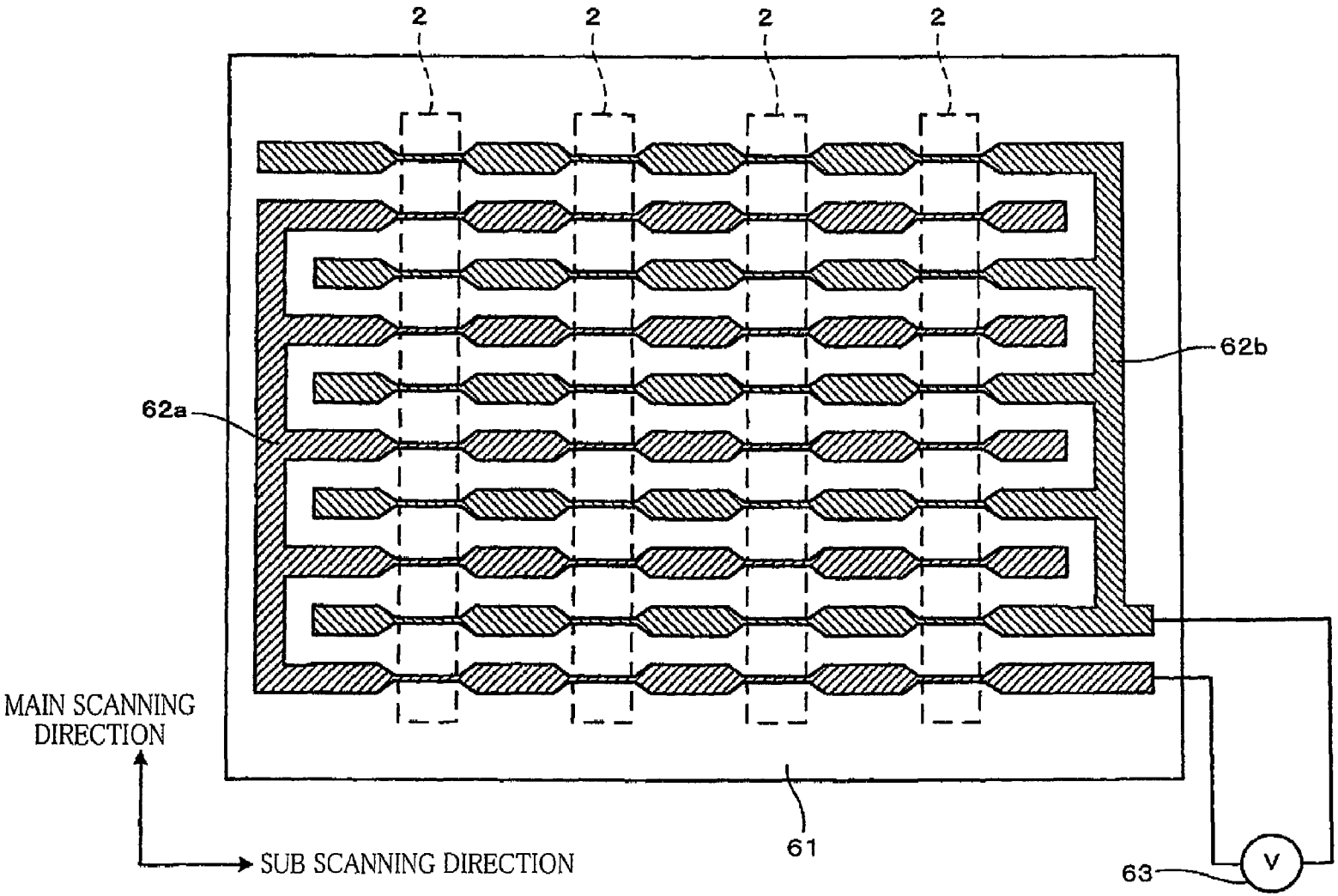
FIG. 3 is a plan view showing comb electrodes.

The pair of comb electrodes 62*a*, 62*b* are provided on the upper surface of the platen 61. The upper surfaces of the comb electrodes 62*a*, 62*b* are coated with a protective layer for protecting the comb electrodes 62*a*, 62*b* from wear or abrasion due to contact thereof with the conveyor belt 53. As shown in FIG. 3, the comb electrodes 62*a*, 62*b* are disposed such that a part of each of the comb electrodes 62*a*, 62*b* is located so as to be opposed to the pressing roller 49. Each comb electrode 62*a*, 62*b* has a plurality of electrode portions, i.e., parallel electrode portions, each of which extends in the sheet conveyance direction A and which are arranged in the main scanning direction. Each electrode portion of one of the comb electrodes 62*a*, 62*b* and each electrode portion of the other of the comb electrodes 62*a*, 62*b* are alternately arranged in the main scanning direction. When a voltage is applied by a power source 63 as a voltage-application power source between the comb electrodes 62*a*, 62*b*, there are constituted capacitors each of which is formed by any adjacent two electrode portions of one and the other of the comb electrodes 62*a*, 62*b* and each of which is through a clearance between the electrode portions and the conveyor belt 53, the conveyor belt 53, a clearance between the conveyor belt 53 and the sheet P, and the sheet P. An infinitesimal current for charging each capacitor passes through the adjacent electrode portions constituting the capacitor, so that an electric field is generated. Accordingly, there is generated, between the sheet P and the electrode portions, a Johnsen-Rahbeck force, i.e., an attractive force. Owing to the attractive force, the sheet P on the conveyor belt 53 is electrostatically attracted to the conveyor surface 54. The power source 63 for applying the voltage between the comb electrodes 62*a*, 62*b* is controlled by the controller 100.

In the present embodiment, the electrostatic attraction of the sheet P is not conducted before the conveyor belt 53 starts to be moved or rotated by the conveyance motor, but is conducted after the conveyor belt 53 has started to be moved or rotated by the conveyance motor by application of the voltage between the pair of comb electrodes 62*a*, 62*b*. Accordingly, in an instance where the attractive force by the comb electrodes 62*a*, 62*b* is not being generated at the conveyor belt 53, the attractive force by the comb electrodes 62*a*, 62*b* is generated after initiation of the rotary movement of the conveyor belt 53. On the other hand, in an instance where the attractive force by the comb electrodes 62*a*, 62*b* remains on the conveyor belt 53, the attractive force by the comb electrodes 62*a*, 62*b* increases after initiation of the rotary movement of the conveyor belt 53.

In the arrangement wherein the voltage is applied between the pair of comb electrodes 62, 62*b* after initiation of the rotary movement of the conveyor belt 53 by the conveyance motor, the attractive force by the comb electrodes 62*a*, 62*b* increases after initiation of the rotary movement of the conveyor belt 53 as described above. The arrangement ensures a reduction in the load that is to be applied to the conveyor belt 53 when the conveyor belt 53 starts to be moved or rotated. Therefore, it is possible to employ a small-sized motor that cannot withstand a large load.

Figure 4:
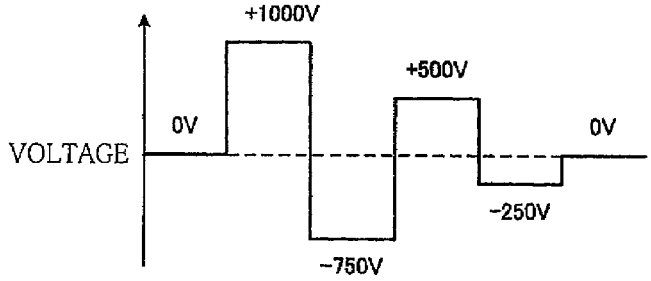
FIG. 4 is a view showing a gradually decreasing alternating voltage.

Further, by applying, between the pair of comb electrodes 62*a*, 62*b*, an alternating voltage that gradually decreases, before initiation of the rotary movement of the conveyor belt 53, the electric charge is eliminated from the conveyor belt 53. The gradually decreasing alternating voltage is a voltage whose level gradually decreases in the order: +1000 V, −750 V, +500 V, −250 V, 0 V, with the polarity alternating between positive and negative, as shown in FIG. 4, for instance. According to the arrangement, the electric charge remaining on the conveyor belt 53 can be eliminated before initiation of the rotary movement of the conveyor belt 53, whereby the attractive force is also eliminated. As a result, a smaller-sized motor can be employed.

Thus, the electric charge remaining on the conveyor belt 53 is eliminated therefrom before initiation of the rotary movement of the conveyor belt 53 by the conveyance motor, whereby it is possible to reduce the load to be applied to the conveyance motor when the conveyor belt 53 starts to be moved or rotated.

The electric charge elimination from the conveyor belt 53 is conducted by applying the gradually decreasing alternating voltage between the pair of comb electrodes 62*a*, 62*b*. By application of the alternating voltage between the comb electrodes 62*a*, 62*b*, the electric charge can be suitably eliminated from the conveyor belt 53. Further, by application of the gradually decreasing alternating voltage between the comb electrodes 62*a*, 62*b*, the electric charge can be quickly or promptly eliminated from the conveyor belt 53.

As shown in FIG. 3, parts of each of the plurality of electrode portions of each comb electrode 62*a*, 62*b* which are opposed to the respective ejection surfaces 2*a* of the ink-jet heads 2 have a width that is made smaller than the other parts thereof which are not opposed to the ejection surfaces 2*a*. Accordingly, the current for charging the capacitors each constituted by any adjacent two electrode portions of one and the other of the comb electrodes 62*a*, 62*b* is hard to flow the electrode portions at the parts thereof that are opposed to the respective ejection surfaces 2*a*. Therefore, it is possible to prevent positions at which the ink droplets ejected from each ink-jet head 2 are to be attached on the sheet P from deviating from prescribed nominal positions due to the electric field between the electrode portions.

In this structure, the conveyor belt 53 moves or rotates by rotation of the belt roller 52 clockwise in FIG. 2 under the control of the controller 100. On this occasion, the belt roller 51, the tension roller 55, and the pressing roller 48 are also rotated by the rotary movement of the conveyor belt 53. Further, on this occasion, the voltage is applied between the pair of comb electrodes 62*a*, 62*b* under the control of the controller 100, whereby the infinitesimal current for charging the capacitors each constituted by any adjacent two electrode portions of one and the other of the comb electrodes 62*a*, 62*b* passes through the adjacent electrode portions, so that the Johnsen-Rahbeck force is generated. According to the arrangement, the sheet P supplied from the sheet supply device 10 is conveyed in the sheet conveyance direction A while being electrostatically attracted to the conveyor surface 54. In the structure, when the sheet P conveyed by and held on the conveyor surface 54 of the conveyor belt 53 passes right below the four ink-jet heads 2, the ink-jet heads 2 controlled by the controller 100 eject the respective inks toward the sheet P, so that an intended color image is formed on the sheet P.

A sensor 71 is disposed at a position between the pressing roller 48 and the most upstream ink-jet head 2 in the sheet conveyance direction A while a sensor 72 is disposed at a position that is downstream of the most downstream ink-jet head 2 in the sheet conveyance direction A, such that the detecting surface of each of the sensors 71, 72 faces the conveyor surface 54. Each sensor 71, 72 is an optical sensor of reflection type configured to detect the sheet P by sensing a light reflected on the surface of the sheet P. The two sensors 71, 72 are disposed at respective positions at which the two sensors 71, 72 are opposed to the middle portion of the conveyor surface 54 in the main scanning direction. These two sensors 71, 72 are configured to detect the leading end of the sheet P conveyed by the conveyor belt 53. It is noted that each sensor 71, 72 is not limited to the optical sensor of reflection type, but may be an optical sensor of transmission type.

In an instance where the sensor 72 does not detect the leading end of the sheet P even though a prescribed time has passed after detection of the leading end of the sheet P by the sensor 71, the controller 100 judges that a jam of the sheet P (so-called paper jam) has occurred on the conveyor mechanism 50. In this instance, the controller 100 stops rotation of the conveyor belt 53 and stops ejection of the inks from the respective ink-jet heads 2.

In an instance where the jam of the sheet P occurs on the conveyor mechanism 50, the voltage applied between the comb electrodes 62*a*, 62*b* is increased, whereby the conveyor belt 53 is attracted or adheres to the platen 61. As a result, the rotary movement of the conveyor belt 53 can be quickly or promptly stopped.

Figure 5:
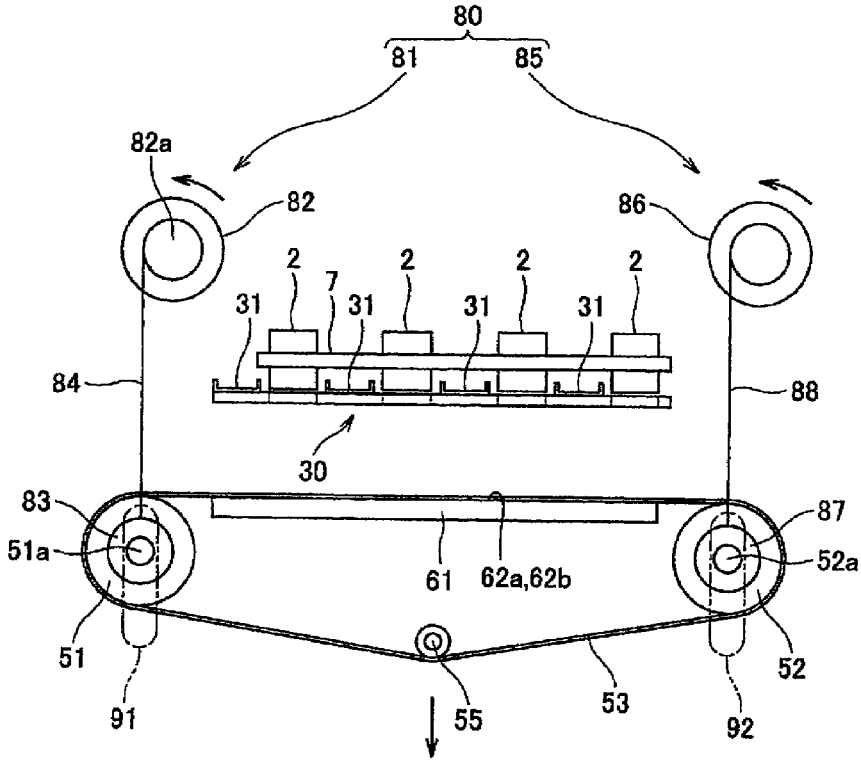
FIG. 5 is a schematic view showing an up/down moving mechanism.

As shown in FIG. 5, the conveyor mechanism 50 is configured to be moved upward and downward relative to the ink-jet heads 2 by an up/down moving mechanism 80 between a printing or recording position at which an image is printed or recorded on the sheet P with the inks ejected from the ink-jet heads 2 and a sheet removal position at which a distance by which the ejection surfaces 2*a* and the conveyor mechanism 50 are spaced apart from each other is larger than that when the ink-jet heads 2 and the conveyor mechanism 50 are located at the printing position and at which a user is allowed to remove the sheet P jammed between the ejection surfaces 2*a* and the conveyor mechanism 50. Each of the printing position and the sheet removal position is defined by relative positions of the ink-jet heads 2 and the conveyor mechanism 50. In other words, the conveyor mechanism 50 is moved upward and downward between the printing position shown in FIG. 2 at which the conveyor mechanism 50 is located close to the ink-jet heads 2 and the sheet removal position at which the conveyor mechanism 50 is located at a height level lower than the printing position.

As shown in FIG. 5, the up/down moving mechanism 80 includes an up/down moving portion 81 configured to move the belt roller 51 upward and downward and an up/down moving portion 85 configured to move the belt roller 52 upward and downward. The up/down moving portion 81 has an up/down motor 82, two rings 83, and wires 84 each as a connecting member. The rings 83 are disposed near respective opposite axial ends of a roller shaft 51*a* of the belt roller 51 and rotatably support the roller shaft 51*a*. Each wire 84 is fixed at one end thereof to the upper end of the corresponding ring 83 and is fixed to and wound around a motor shaft 82*a* of the up/down motor 82 at the other end thereof. At respective positions of the casing 1*a* facing the opposite axial ends of the roller shaft 51*a* of the belt roller 51, guides 91 are formed for guiding the opposite axial ends of the roller shaft 51*a* of the belt roller 51 when the belt roller 51 is moved upward and downward. Each guide 91 is formed such that its upper end coincides with the position of the roller shaft 51*a* at a time when the conveyor mechanism 50 is located at the printing position. The guide 91 extends downward from its upper end.

Similarly, the up/down moving portion 85 has an up/down motor 86, two rings 87, and wires 88 each as a connecting member. The rings 87 are disposed near respective opposite axial ends of a roller shaft 52*a* of the belt roller 52 and rotatably support the roller shaft 52*a*. Each wire 88 is fixed at one end thereof to the upper end of the corresponding ring 87 and is fixed to and wound around a motor shaft 86*a* of the up/down motor 86 at the other end thereof. At respective positions of the casing 1*a* facing the opposite axial ends of the roller shaft 52*a* of the belt roller 52, guides 92 are formed for guiding the opposite axial ends of the roller shaft 52*a* of the belt roller 52 when the belt roller 52 is moved upward and downward. Each guide 92 is formed such that its upper end coincides with the position of the roller shaft 52*a* at a time when the conveyor mechanism 50 is located at the printing position. The guide 92 extends downward from its upper end.

In the structure, when the two up/down motors 82, 86 are simultaneously driven under the control of the controller 100 and the motor shafts 82*a*, 86*a* are rotated counterclockwise in FIG. 5, the wires or connecting members 84, 88 are unwound from the respective motor shafts 82*a*, 86*a*, whereby the conveyor mechanism 50 moves downward along the guides 91, 92. That is, the conveyor mechanism 50 is moved from the printing position to the sheet removal position. On the other hand, when the motor shafts 82*a*, 86*a* are rotated clockwise in FIG. 5 under the control of the controller 100, the wires or connecting members 84, 88 are wound around the respective motor shafts 82*a*, 86*a*, whereby the conveyor mechanism 50 moves upward along the guides 91, 92. That is, the conveyor mechanism 50 is moved from the sheet removal position to the printing position.

The movement of the conveyor mechanism 50 from the printing position to the sheet removal position is conducted in an instance where a jam of the sheet P occurs at the conveyor mechanism 50 in a printing or recording operation in which an image is being printed or recorded on the sheet P with the conveyor mechanism 50 located at the printing position. When the conveyor mechanism 50 is located at the sheet removal position, the distance between the ejection surfaces 2*a* and the conveyor mechanism 50 is large, thereby allowing the user easy access to the conveyor mechanism 50 by opening the first door 4, so that the jammed sheet P can be easily removed.

In an instance where the jam of the sheet P occurs at the conveyor mechanism 50 and the conveyor mechanism 50 is moved to the sheet removal position, the gradually decreasing alternating voltage is applied between the pair of comb electrodes 62*a*, 62*b*, so that the electric charge is eliminated from the conveyor belt 53. Accordingly, the user can easily remove the jammed sheet P from the conveyor belt 53.

The movement of the conveyor mechanism 50 from the printing position to the sheet removal position may be conduced in an instance where the jam of the sheet P occurs with the sheet P extending over the sheet guide 17 and the conveyor mechanism 50 and in an instance where the jam of the sheet P occurs with the sheet P extending over the conveyor mechanism 50 and the sheet guide 18.

While the conveyor mechanism 50 is configured to be moved upward and downward relative to the ink-jet heads 2 by the up/down moving mechanism 80 in the present embodiment, the ink-jet heads 2 may be configured to be moved upward and downward relative to the conveyor mechanism 50 by the up/down moving mechanism 80. Further, both of the ink-jet heads 2 and the conveyor mechanism 50 may be configured to be moved upward and downward by the up/down moving mechanism 80 such that the conveyor mechanism 50 and the ink-jet heads 2 approach each other or separate away from each other.

As shown in FIG. 2, a separation plate 9 is disposed on the immediately downstream side of the conveyor mechanism 50 in the sheet conveyance direction A. The separation plate 9 is configured to separate the sheet P from the conveyor surface 54 such that the edge of the separation plate 9 is inserted between the sheet P and the conveyor belt 53.

At a portion of the sheet transfer path between the conveyor mechanism 50 and the discharged-sheet receiving portion 15, there are disposed: four feed rollers 21*a*, 21*b*, 22*a*, 22*b*; and the sheet discharge guide 18 located between the feed rollers 21*a*, 21*b* and the feed rollers 22*a*, 22*b*. The feed rollers 21*b*, 22*b* are rotatably driven by a feed motor (not shown) controlled by the controller 100. The feed rollers 21*a*, 22*a* are driven rollers configured to be rotated as the sheet is transferred. The sheet discharge guide 18 is constituted by the outer guide surface 18*a* formed on the third door 5 and an inner guide surface 18*b* opposed to the outer guide surface 18*a*.

In the arrangement described above, the feed motor is driven under the control of the controller 100 so as to rotate the feed rollers 21*b*, 22*b*, whereby the sheet P conveyed by the conveyor mechanism 50 is transferred upward in FIG. 2 through the sheet discharge guide 18 while being held by the feed rollers 21*a*, 21*b*. Subsequently, the sheet P is discharged to the discharged-sheet receiving portion 15 while being held by the feed rollers 22*a*, 22*b*.

A sensor 75 is disposed at a position which is downstream of the separation plate 9 and is upstream of the feed rollers 21*a*, 21*b* while a sensor 76 is disposed at a position which is downstream of the sheet discharge guide 18 and is upstream of the feed rollers 22*a*, 22*b*. Each of the sensors 75, 76 is disposed such that its detecting surface is opposed to the sheet P passing through the sheet discharge guide 18. Each sensor 75, 76 is an optical sensor of reflection type configured to detect the sheet P by sensing a light reflected on the surface of the sheet P. The two sensors 75, 76 are disposed at respective positions at which the two sensors 75, 76 are opposed to the inner central portion of the sheet discharge guide 18 in the main scanning direction. These two sensors 75, 76 are configured to detect the leading end of the sheet P passing through the sheet discharge guide 18. It is noted that each sensor 75, 76 is not limited to the optical sensor of reflection type, but may be an optical sensor of transmission type.

In an instance where the sensor 76 does not detect the leading end of the sheet P even though a prescribed time has passed after detection of the leading end of the sheet P by the sensor 75, the controller 100 judges that a jam of the sheet P (so-called paper jam) has occurred in the sheet discharge guide 18. In this instance, the controller 100 stops rotation of the feed rollers 21*b*, 22*b*.

As shown in FIG. 2, the maintenance mechanism 30 is disposed between the four ink-jet heads 2 and the conveyor mechanism 50. The maintenance mechanism 30 has four caps 31 configured to cover the ejection surfaces 2*a* of the respective ink-jet heads 2. Each of the caps 31 is formed of an elastic material such as rubber and has a rectangular shape in plan view whose longitudinal direction is parallel to the longitudinal direction of each ink-jet head 2. Each cap 31 is located, in its initial state, at a standby position that is on the immediately upstream side of the corresponding ink-jet head 2, and is moved, in accordance with the movement of the maintenance mechanism 30, in the leftward and rightward direction and in the upward and downward direction as seen in FIG. 2, relative to the corresponding ink-jet head 2.

Figure 6A:
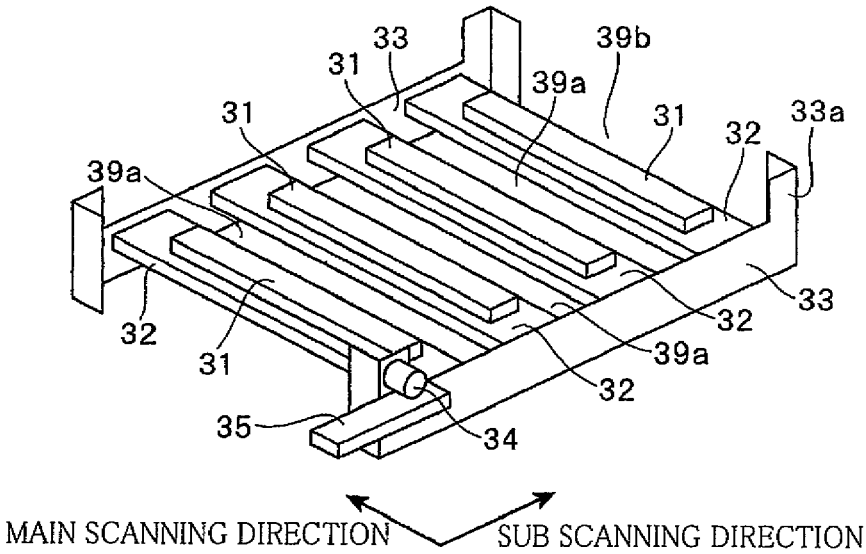
FIGS. 6A and 6B are perspective views showing a maintenance mechanism.

As shown in FIG. 6A, the maintenance mechanism 30 includes: four plate members 32 which are equally spaced apart from each other in the sub scanning direction and each of which has the cap 31 disposed on its upper surface; and a pair of inner frames 33 between which the plate members 32 are held. Each inner frame 33 has protruding corner portions 33*a* that extend upward at respective opposite ends thereof. On one corner portion 33*a* of each inner frame 33, a pinion gear 34 that is fixed to a shaft of a drive motor (not shown) is disposed so as to mesh with a rack gear 35 disposed horizontally. In FIG. 6A, the pinion gear 34 of only one of the inner frames 33 (that is located on the front side as seen in FIG. 6A) is shown.

Figure 6B:
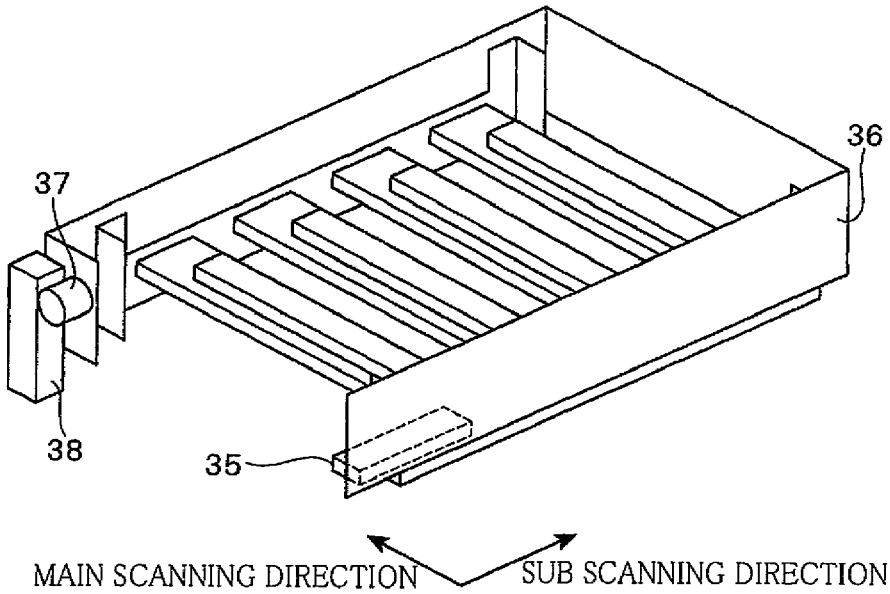

As shown in FIG. 6B, the maintenance mechanism 30 further includes an outer frame 36 disposed so as to enclose the pair of inner frames 33. Inside the outer frame 36, the rack gear 35 shown in FIG. 6A is fixed. The outer frame 36 is provided with a pinion gear 37 that is fixed to a shaft of a drive motor (not shown). The pinion gear 37 is disposed so as to mesh with a rack gear 38 disposed vertically. The rack gear 38 is disposed so as to extend upright in the casing 1*a*.

In the arrangement described above, when the two pinion gears 34 are synchronously rotated, the inner frames 33 are moved in the sub scanning direction. Further, when the pinion gear 37 is rotated, the outer frame 36 is moved in the vertical direction.

Figure 7A:
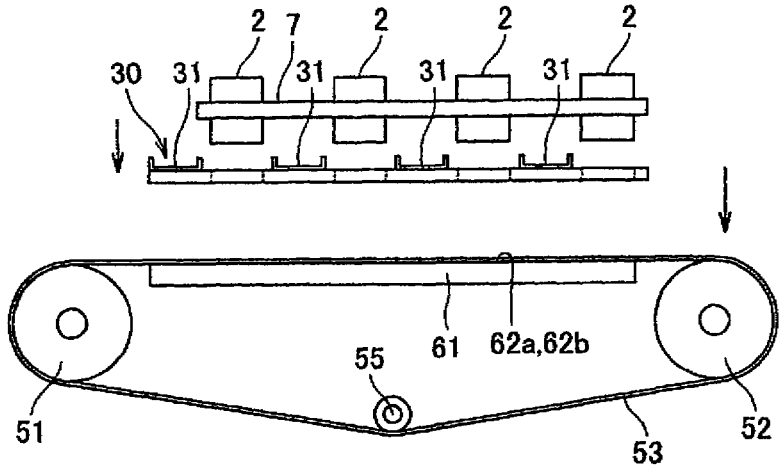
FIGS. 7A-7C are views showing a capping operation.

More specifically, when the maintenance mechanism 30 is located at the standby position shown in FIG. 2, each plate member 32 is located on the immediately upstream side of the corresponding ink-jet head 2, and three openings 39*a* between any adjacent two plate members 32 and one opening 39*b* between the plate member 32 located on the most downstream side and the corner portions 33*a* of the inner frames 33 are opposed to the respective ejection surfaces 2*a*. When a capping operation for covering the ejection surfaces 2*a* with the corresponding caps 31 is conducted, the outer frame 36 is moved downward in the vertical direction as shown in FIG. 7A, so that the maintenance mechanism 30 is moved to a position between the ink-jet heads 2 and the conveyor mechanism 50. Accordingly, the caps 31 are located at an intervening position which is between the ink-jet heads 2 and the conveyor mechanism 50 and at which the caps 31 are not opposed to the ejection surfaces 2*a*.

Figure 7B:
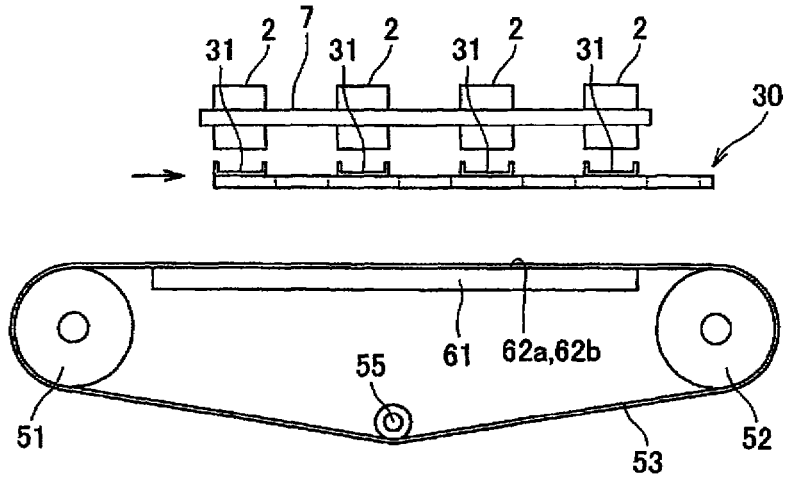
Figure 7C:
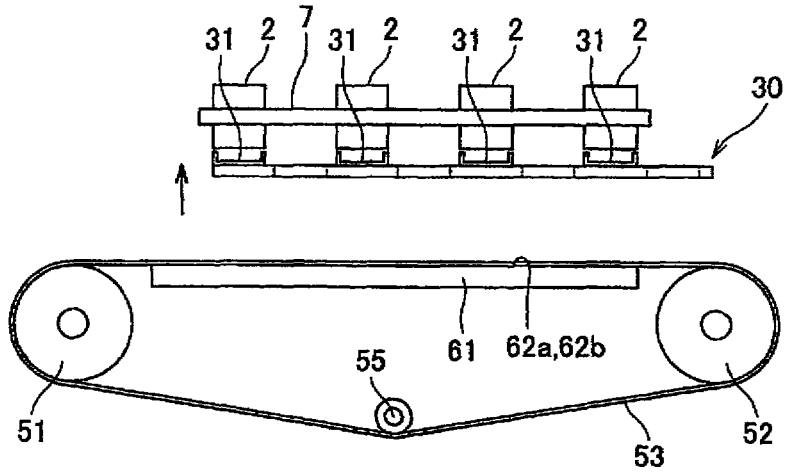

Thereafter, the pair of inner frames 33 are moved downstream in the sub scanning direction, as shown in FIG. 7B. On this occasion, the caps 31 are located at a facing position at which the caps 31 face the corresponding ejection surfaces 2*a*. Then the outer frame 36 is moved upward in the vertical direction, whereby the caps 31 are located at a capping position at which the caps 31 contact the corresponding ejection surfaces 2*a* so as to cover the same 2*a*, as shown in FIG. 7C. According to this procedure, the ejection surfaces 2*a* are covered with the respective caps 31. The caps 31 return back to the standby position by conducting the procedure in a reverse order.

The capping operation described above is conducted with the conveyor mechanism 50 located at the sheet removal position after having been moved downward from the printing position by the up/down moving mechanism 80 or with the conveyor mechanism 50 located at the printing position.

During a time period in which the capping operation is being conducted, the voltage is applied between the comb electrodes 62*a*, 62*b* for electrostatic attraction. Accordingly, the jammed sheet P can be attracted to the conveyor surface 54, thereby preventing interference of the caps 31 and the sheet P with each other.

<Electric Structure of Ink-Jet Printer>

Figure 8:
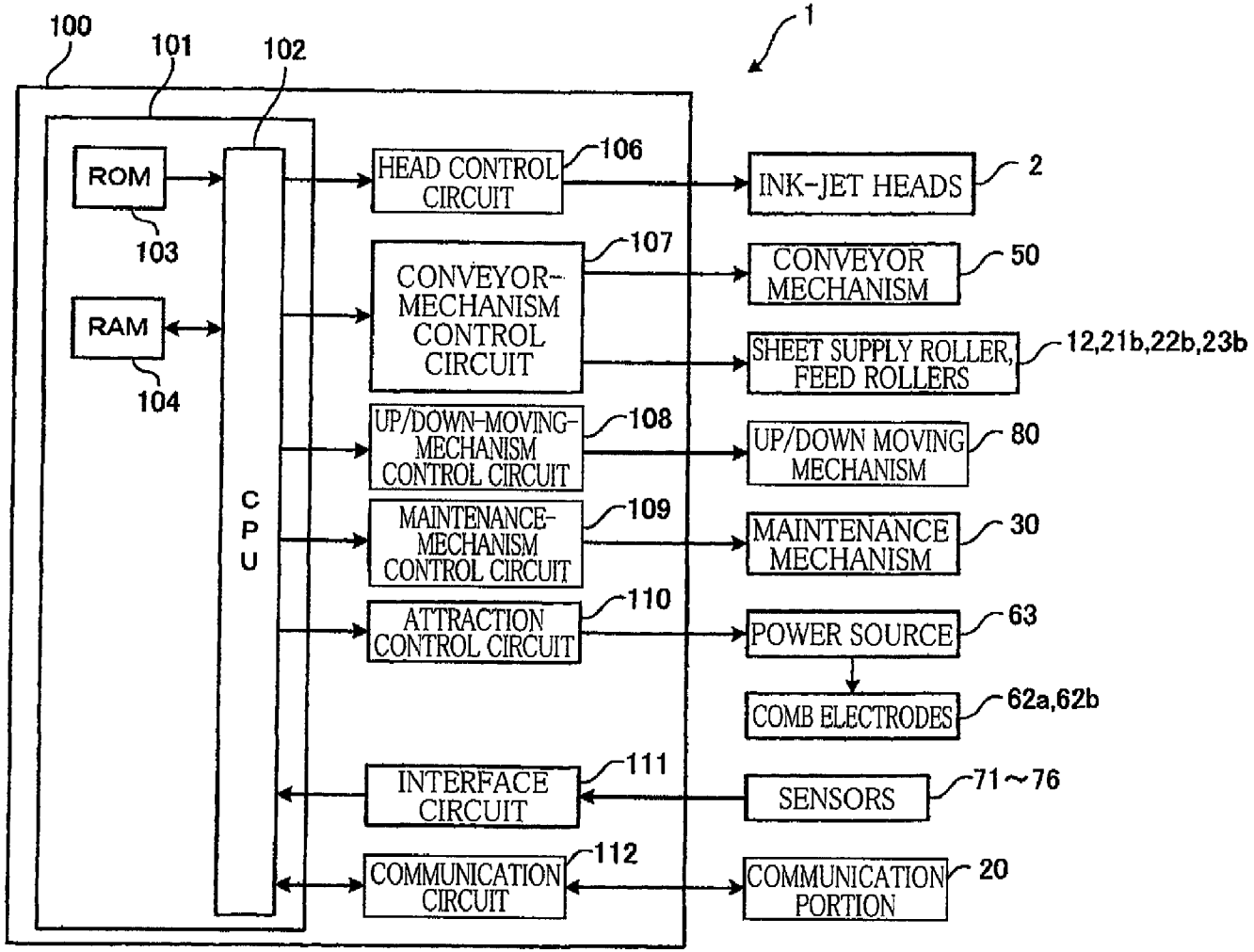
FIG. 8 is a diagram showing an electrical structure of the ink-jet printer.

The operations of the ink-jet printer 1 are controlled by the controller 100, as shown in FIG. 8. The controller 100 is constituted by a microcomputer 101 as its main constituent element disposed on a circuit board, and various circuits. The microcomputer 101 includes a Central Processing Unit (CPU) 102 for controlling various operations according to preset programs, a Read Only memory (ROM) 103 in which various programs are stored, and a Random Access Memory (RAM) 104 as a temporary memory device.

To the CPU 102, there are connected: a head control circuit 106 for controlling the ink-jet heads 2; a conveyor-mechanism control circuit 107 for controlling the conveyor mechanism 50, the feed rollers 21*b*, 22*b*, 23*b*, and the sheet supply roller 12; an up/down-moving-mechanism control circuit 108 for controlling the up/down moving mechanism 80; a maintenance-mechanism control circuit 109 for controlling the maintenance mechanism 30; an attraction control circuit 110 for controlling the power source 63 by which the voltage is applied between the pair of comb electrodes 62*a*, 62*b*; an interface circuit 111 to which sheet detection signals from the sensors 71-76 are inputted; and a communication circuit 112 for performing communication with a general-purpose personal computer (not shown) or the like via a communication portion 20. The CPU 102 controls those circuits. It is noted that the CPU 102 and the attraction control circuit 110 constitute an attraction control portion.

The head control circuit 106 is configured to control the ink-jet heads 2 to eject the inks toward the sheet P, on the basis of printing or recording data transmitted from the personal computer or the like via the communication portion 20. On this occasion, the head control circuit 106 controls the ink-jet heads 2 to start ejection of the inks toward the sheet P a predetermined time after the sensor 71 has detected the leading end of the sheet P conveyed by the conveyor mechanism 50. The above-indicated predetermined time is equal to a time obtained by dividing a distance, along the sheet transfer path, between the position of the leading end of the sheet P when the sensor 71 detects the leading end and the position of the ejection openings which are located most upstream in the most upstream one of the four ink-jet heads 2, by a speed at which the sheet P is transferred.

The conveyor-mechanism control circuit 107 is configured to control the conveyor mechanism 50, the feed rollers 21*b*, 22*b*, 23*b*, and the sheet supply roller 12 such that the sheet P is transferred from the sheet supply device 10 to the discharged-sheet receiving portion 15.

The up/down-moving-mechanism control circuit 108 is configured to control the up/down moving mechanism 80 such that the conveyor mechanism 50 is moved away from the ink-jet heads 2 when a jam of the sheet P that is being conveyed has occurred, for instance. In particular, the up/down-moving-mechanism control circuit 108 is configured to control the up/down moving mechanism 80 such that the conveyor mechanism 50 and the ink-jet heads 2 are moved relative to each other from the printing position to the sheet removal position where a jam of the sheet P at the conveyor mechanism has detected.

The maintenance-mechanism control circuit 109 is configured to control the maintenance mechanism 30 to conduct the capping operation when a jam of the sheet P that is being conveyed occurs. In particular, the maintenance-mechanism control circuit 109 is configured to control the maintenance mechanism 30 such that the caps 31 are moved from the standby position to the intervening position in synchronism with the relative movement of the conveyor mechanism 50 and the ink-jet heads 2 by the up/down moving mechanism 80 from the printing position to the sheet removal position.

The attraction control circuit 110 is configured to control the power source 63 so as to apply the voltage between the pair of comb electrodes 62*a*, 62*b*. In particular, the attraction control circuit 110 is configured to control the power source 63 such that, before the conveyor mechanism 50 starts conveyance of the sheet P, the gradually decreasing alternating voltage is applied between the comb electrodes 62*a*, 62*b* P so as to eliminate the electrical charge from the conveyor belt 53 and such that, after the conveyor mechanism 50 has started conveyance of the sheet P, the voltage is applied between the comb electrodes 62*a*, 62*b* so as to permit the sheet P to be electrostatically attracted to the conveyor surface 54. Further the attraction control circuit 110 is configured to control the power source 63 such that, in an instance where the jam of the sheet P occurs on the conveyor mechanism 50, the voltage applied between the comb electrodes 62*a*, 62*b* is increased so as to permit the conveyor belt 53 to be attracted to the platen 61 for thereby promptly or quickly stopping the rotation of the conveyor belt 53. Moreover, the attraction control circuit 110 is configured to control the power source 63 such that the voltage is applied between the comb electrodes 62*a*, 62*b* during a time period in which the capping operation is being conducted, so as to permit the jammed sheet P to be attracted to the conveyor surface 54 for thereby preventing interference of the caps 31 and the sheet P with each other. In other words, the voltage is kept applied even in a situation in which the jam of the sheet P occurs. In addition, the attraction control circuit 110 is configured to control the power source 63 such that, in an instance where the jam of the sheet P occurs at the conveyor mechanism 50 and the conveyor mechanism 50 is moved to the sheet removal position, the gradually decreasing alternating voltage is applied between the comb electrodes 62*a*, 62*b* so as to eliminate the electric charge from the conveyor belt 53 for thereby allowing the user to easily remove the jammed sheet P from the conveyor belt 53.

The CPU 102 judges that a jam of the sheet P has occurred only when a time interval of detection of the sheet P by the two sensors in each of the three sets of sensors, i.e., the sensors 71 and 72, the sensors, 73 and 74, and the sensors 75 and 76, exceeds respective preset values. In other words, the CPU 102 judges that a jam of the sheet P has occurred in an instance where the downstream-side sensor of each set does not detect the leading end of the sheet P before a prescribed time elapses after detection of the leading end of the sheet P by the upstream-side sensor of the set. The prescribed time is equal to a time obtained by diving the distance between the two sensors in each set along the sheet transfer path, by the sheet transfer speed.

More specifically, the CPU 102 initially judges that a jam of the sheet P has occurred in the sheet supply guide 17 in an instance where the sensor 74 does not yet detect the leading end of the sheet P at an expected time point at which the prescribed time has elapsed from the time point of detection of the leading end of the sheet P by the sensor 73, namely, in an instance where the sensor 74 does not detect the leading end of the sheet P before the prescribed time elapses after detection of the leading end of the sheet P by the sensor 73. Here, the prescribed time is equal to a time obtained by dividing the distance between the sensor 73 and the sensor 74, by the sheet transfer speed.

The CPU 102 next judges that a jam of the sheet P has occurred at the conveyor mechanism 50 in an instance where the sensor 72 does not detect the leading end of the sheet P before the prescribed time elapses after detection of the leading end of the sheet P by the sensor 71. Here, the prescribed time is equal to a time obtained by dividing the distance between the sensor 71 and the sensor 72, by the sheet transfer speed.

The CPU 102 then judges that a jam of the sheet P has occurred in the sheet discharge guide 18 in an instance where the sensor 76 does not detect the leading end of the sheet P before the prescribed time elapses after detection of the leading end of the sheet P by the sensor 75. Here, the prescribed time is equal to a time obtained by dividing the distance between the sensor 75 and the sensor 76, by the sheet transfer speed.

The head control circuit 106 stops ejection of the ink from each ink-jet head 2 and the conveyor-mechanism control circuit 107 stops conveyance of the sheet P by the conveyor mechanism 50 where the CPU 102 judges that the sheet jam has occurred. Where the time interval of detection of the sheet P by the two sensors in each of the three sets of sensors is held within the prescribed time and the CPU 102 does not judge the occurrence of the sheet jam, the inks are ejected to the sheet P in a state in which the ink-jet heads 2 are opposed to the sheet P, whereby an image is formed on the sheet P. The image-formed sheet P is discharged onto the discharged-sheet receiving portion 15.

<Operations of the Ink-Jet Printer>

Figure 9:
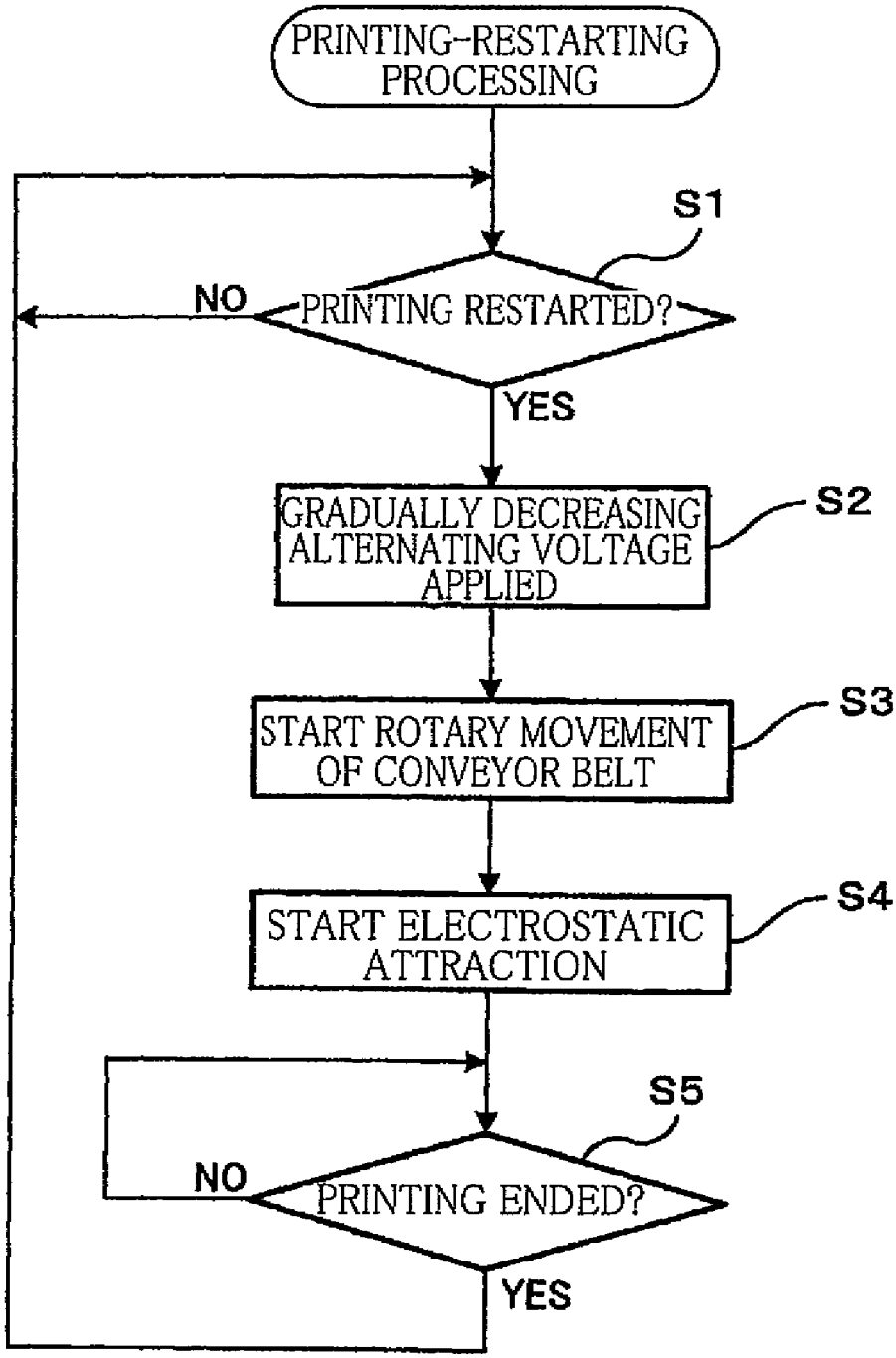
FIG. 9 is a view showing a printing-restarting routine.
Figure 10:
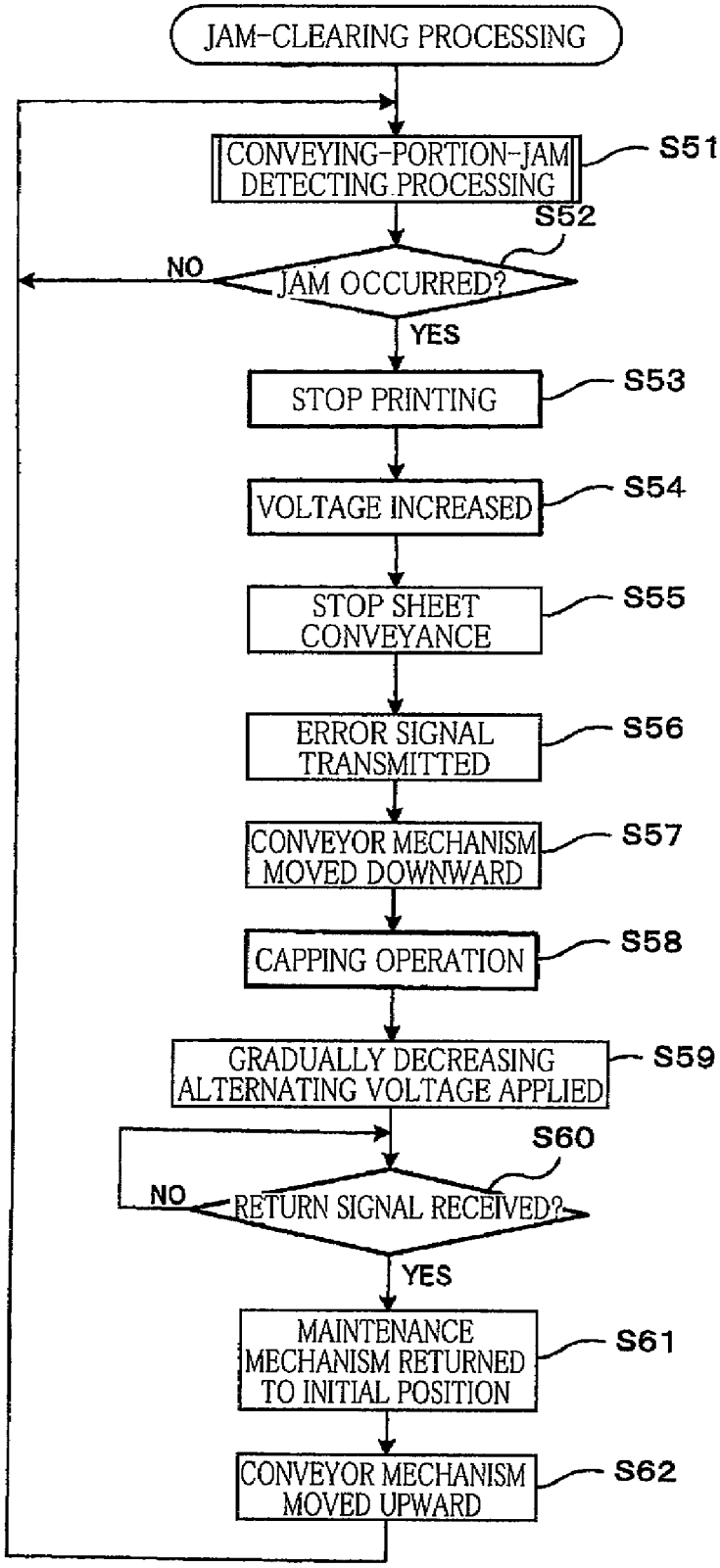
FIG. 10 is a view showing a jam-clearing routine.

There will be next explained operations of the thus constructed ink-jet printer 1 referring to a printing-restarting routine shown in FIG. 9 and a jam-clearing routine shown in FIG. 10.

1. Printing-Restarting Routine

The printing-restarting routine shown in FIG. 9 starts with step S1 (hereinafter "step" is omitted where appropriate) to judge whether the printing operation is restarted or not. Where it is judged that the printing operation is not restarted, the control flow goes back to S1. On the other hand, where it is judged that the printing operation is restarted, S2 is implemented to apply the gradually decreasing alternating voltage between the pair of comb electrodes 62*a*, 62*b*.

Subsequently, the conveyor belt 53 starts rotating or moving in S3. Then S4 is implemented to start electrostatic attraction by application of the voltage between the comb electrodes 62*a*, 62*b*.

Thus, the electric charge is eliminated from the conveyor belt 53 before initiation of the rotary movement of the conveyor belt 53 by the conveyance motor, and the attractive force remaining on the conveyor belt 53 is thereby removed therefrom, so that it is possible to reduce the load to be applied to the conveyance motor when the conveyor belt 53 starts rotating or moving.

Further, the electric charge can be suitably eliminated from the conveyor belt 53 by application of the alternating voltage between the pair of comb electrodes 62*a*, 62*b*, and the electric charge can be promptly or quickly eliminated from the conveyor belt 53 by application of the gradually decreasing alternating voltage between the pair of comb electrodes 62*a*, 62*b*.

Moreover, the voltage is applied between the pair of comb electrodes 62*a*, 62*b* after initiation of the rotary movement of the conveyor belt 53 by the conveyance motor, so that the attractive force by the comb electrodes 62*a*, 62*b* increases after initiation of the rotary movement of the conveyor belt 53. Accordingly, it is possible to reduce the load to be applied to the conveyor belt 53 when the conveyor belt 53 starts rotating or moving.

Thereafter, it is judged in S5 whether the printing operation is ended or not. Where it is judged that the printing operation is not yet ended, step S5 is repeatedly implemented until the printing operation is ended. On the other hand, where it is judged that the printing operation is ended, the control flow goes back to S1.

<Jam-Clearing Routine>

The jam-clearing routine shown in FIG. 10 starts with step S51 in which a conveyor-portion-jam detecting processing (that will be explained with reference to the routine of FIG. 11) is conducted. The conveyor-portion-jam detecting processing is for detecting the sheet jam at the conveyance mechanism 50. Sheet jams in the sheet supply guide 17 and the sheet discharge guide 18 are detected according to respective routines, which are not explained here.

S51 is followed by S52 to judge whether a sheet jam has occurred at the conveyor mechanism 50. Where it is judged that the sheet jam has not occurred, the control flow goes back to S51. On the other hand, where it is judged that the sheet jam has occurred, S53 is implemented in which the head control circuit 106 controls the ink-jet heads 2 so as to stop printing and S54 is implemented in which the power source 63 is controlled so as to increase the voltage applied between the pair of comb electrodes 62*a*, 62*b*, whereby the conveyor belt 53 is attracted to the platen 61. Consequently, the rotary movement of the conveyor belt 53 is promptly or quickly stopped.

S54 is followed by S55 in which the conveyor-mechanism control circuit 107 controls the conveyor mechanism 50, the feed rollers 21*b*, 22*b*, 23*b*, and the sheet supply roller 12 so as to stop conveyance or transfer of the sheet P. Then S56 is implemented in which an error signal is transmitted from the communication circuit 112 to the exterior via the communication portion 20.

Subsequently, S57 is implemented in which the up/down-moving-mechanism control circuit 108 controls the up/down moving mechanism 80 to move the conveyor mechanism 50 downward, so that the conveyor mechanism 50 is located at the sheet removal position distant from the ink-jet heads 2. In synchronism with the control of the up/down moving mechanism 80 by the up/down-moving-mechanism control circuit 108 in S57, the maintenance-mechanism control circuit 109 controls the maintenance mechanism 30 in S58 to conduct the capping operation, so that the ejection surfaces 2*a* are covered with the respective caps 31. On this occasion, since the voltage is being applied between the comb electrodes 62*a*, 62*b* for electrostatic attraction, the jammed sheet P is attracted to the conveyor surface 54, thereby preventing the caps 31 and the sheet P from interfering with each other.

Subsequently, S59 is implemented in which the gradually decreasing alternating voltage is applied between the comb electrodes 62*a*, 62*b*, whereby the electric charge is eliminated from the conveyor belt 53. Accordingly, the user can easily remove the jammed sheet P from the conveyor belt 53. In this instance, the user carries out the jam-clearing operation for removing the jammed sheet P by opening the first door 4.

S59 is followed by S60 in which it is judged whether a return signal for allowing the maintenance mechanism 30 to return to the initial position after completion of the jam-clearing operation by the user has been received. Where it is judged that the return signal is not received yet, S60 is repeatedly implemented until the return signal is received. On the other hand, where it is judged that the return signal has been received, S61 is implemented in which the maintenance-mechanism control circuit 109 controls the maintenance mechanism 30 such that the maintenance mechanism 30 returns back to the initial position. S61 is followed by S62 in which the up/down-moving-mechanism control circuit 108 controls the up/down moving mechanism 80 to move the conveyor mechanism 50 upward, so that the conveyor mechanism 50 is located at the printing position near the ink-jet heads 2. Then the control flow goes back to S51.

<Conveyor-Portion-Jam Detecting Routine>

Figure 11:
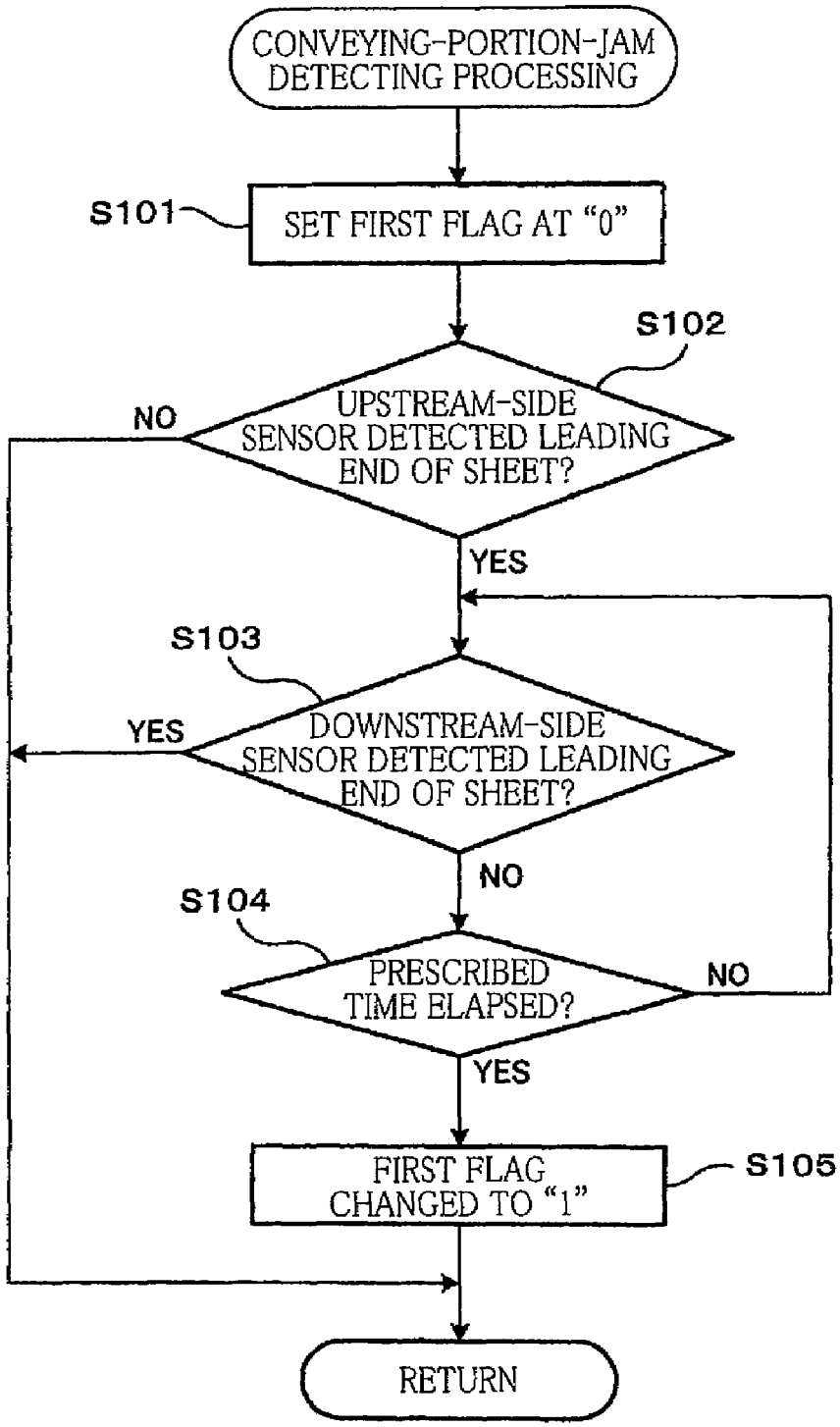
FIG. 11 is a view showing a routine for detecting a jam at a conveyor portion.

With reference to FIG. 11, the conveyor-portion-jam detecting routine executed in S51 of the routine of FIG. 10 will be explained. As shown in FIG. 11, a first flag is set at "0" in S101. Along with a second flag used in the processing for detecting the sheet jam at the sheet supply guide 17 and a third flag used in the processing for detecting the sheet jam at the sheet discharge guide 18, the first flag is used for judging whether the sheet jam has occurred or not and for judging where the sheet jam has occurred. The first flag is changed to "1" in an instance where the sheet jam has occurred. For instance, where the first flag is "1", the second flag is "0", and the third flag is "0", it is judged that the sheet jam has occurred at the conveyor mechanism 50.

Subsequently, it is judged in S102 whether the upstream-side sensor 71 has detected the leading end of the sheet P. Where it is judged in S102 that the upstream-side sensor 71 has not yet detected the leading end of the sheet P, the sub routine is ended and the control flow goes back to the jam-clearing routine of FIG. 10. On the other hand, where it is judged in S102 that the upstream-side sensor 71 has detected the leading end of the sheet P, it is judged in S103 whether the downstream-side sensor 72 has detected the leading end of the sheet P.

Where it is judged that the downstream-side sensor 72 has detected the leading end of the sheet P, the sub routine is ended and the control flow goes back to the jam-clearing routine of FIG. 10. On the other hand, where it is judged that the downstream-side sensor 72 has not yet detected the leading end of the sheet P, it is judged in S104 that the prescribed time has elapsed. Where it is judged that the prescribed time has not elapsed, the control flow goes back to S103. On the other hand, where it is judged that the prescribed time has elapsed, it is judged that the sheet jam has occurred, and the first flag is changed from "0" to "1" in S105. Then the sub routine is ended and the control flow goes back to the jam-clearing routine of FIG. 10.

<Modifications>

While the presently preferred embodiment has been described, it is noted that the invention is not limited to the details of the illustrated embodiment, but may be embodied with various changes and modifications, which may occur to those skilled in the art, without departing from the spirit and scope of the invention defined in the attached claims. It is further noted that the effects of the invention described in the illustrated embodiment are preferable ones arising from the invention and that the effects of the invention are not limited to those described in the illustrated embodiment.

While, in the illustrated embodiment, the comb electrodes are provided on the platen 61, the comb electrodes may be embedded in the conveyor belt 53. In this instance, each of the plurality of electrode portions of each comb electrode may have a constant width.

While, in the illustrated embodiment, each of the electrode portions of each comb electrode extends in the sheet conveyance direction A, each electrode portion may extend in the main scanning direction.

In the illustrated embodiment, the electric charge may not be eliminated from the conveyor belt 53. The elimination of the electric charge from the conveyor belt 53 may be conducted in a manner other than application of the alternating voltage between the pair of comb electrodes 62*a*, 62*b*. Further, the alternating voltage to be applied between the pair of comb electrodes 62*a*, 62*b* is not limited to the gradually decreasing alternating voltage.

In the illustrated embodiment, the elimination of the electric charge from the conveyor belt 53 and the application of the voltage between the pair of comb electrodes 62*a*, 62*b* are conducted when the rotary movement of the conveyor belt 53 restarts. The elimination of the electric charge and the application of the voltage between the pair of comb electrodes 62*a*, 62*b* may be conducted at timing other than the timing of restarting of the rotary movement of the conveyor belt 53.

The ink-jet recording apparatus according to the present invention is not limited to the ink-jet type, but may be applicable to a thermal type. Further, the ink-jet recording apparatus according to the present invention is not limited to the line type, but may be applicable to a serial type in which the heads are reciprocated. The principle of the invention may be applicable to not only the printer, but also a facsimile machine, a copying machine, and the like. While the conveyor mechanism 50 in the illustrated embodiment is configured to convey the sheet P in the horizontal direction, the conveyor mechanism 50 may be configured to convey the sheet P in directions other than the horizontal direction such as a direction inclined with respect to the horizontal direction, the vertical direction, etc., by arranging the conveyor surface 54 such that the conveyor surface 54 that is parallel to the ejection surfaces 2 is inclined or vertical with respect to the horizontal direction.

What is claimed is:

1. An ink jet recording apparatus, comprising:

an inkjet head in which is formed an ejection surface through which ink is ejected;

a conveyor mechanism which includes: a conveyor belt having a conveyor surface that is opposed the ejection surface; and a belt drive mechanism configured to move the conveyor belt and which is configured to convey a recording medium on the conveyor surface in a medium conveyance direction in which the recording medium is conveyed;

a pair of comb electrodes which are disposed so as to be opposed to the ejection surface with the conveyor surface interposed therebetween, each of the comb electrodes including a plurality of electrode portions that are arranged in a direction perpendicular to a direction in which the comb electrodes are opposed to the ejection surface, each of the plurality of electrode portions of one of the comb electrodes and each of the plurality of electrode portions of the other of the comb electrodes being alternately arranged in the direction in which the plurality of electrode portions of each of the comb electrodes are arranged;

a voltage-application power source configured to apply a voltage between the pair of comb electrodes; and a controller which has an attraction control portion configured to control the voltage-application power source so as to attract the recording medium to the conveyor surface and which controls operations of the ink jet recording apparatus, wherein the attraction control portion is configured to control the voltage-application power source such that the voltage is applied between the pair of comb electrodes after initiation of the movement of the conveyor belt by the belt drive mechanism, and wherein the attraction control portion is configured to control the voltage-application power source such that the voltage is applied between the pair of comb electrodes before initiation of the movement of the conveyor belt by the belt drive mechanism, for eliminating electric charge remaining on the conveyor belt.

2. The ink jet recording apparatus according to claim 1, wherein the attraction control portion is configured to control the voltage-application power source such that an alternating voltage is applied between the pair of comb electrodes for elimination of the electric charge from the conveyor belt.

3. The ink jet recording apparatus according to claim 2, wherein the attraction control portion is configured to control the voltage-application power source such that the alternating voltage that is gradually decreasing is applied between the pair of comb electrodes for elimination of the electric charge from the conveyor belt.

4. The ink jet recording apparatus according to claim 1, wherein the attraction control portion is configured to control the voltage-application power source such that the voltage is kept applied between the pair of comb electrodes even in a situation in which a jam of the recording medium occurs between the conveyor surface of the conveyor belt and the ejection surface of the ink-jet head during conveyance of the recording medium by the conveyor mechanism.

5. The ink jet recording apparatus according to claim 4, wherein the attraction control portion is configured to control the voltage-application power source such that the voltage to be applied between the pair of comb electrodes is increased in a situation in which the jam of the recording medium occurs between the conveyor surface of the conveyor belt and the ejection surface of the ink jet head during conveyance of the recording medium by the conveyor mechanism.

6. The ink jet recording apparatus according to claim 4, wherein the attraction control portion is configured to control the voltage-application power source such that electric charge is eliminated from the conveyor belt when the recording medium jammed between the conveyor surface of the conveyor belt and the ejection surface of the ink jet head is removed.

7. The ink jet recording apparatus according to claim 1, wherein a part of each of the plurality of electrode portions of each of the comb electrodes which is opposed to the ejection surface of the ink-jet head has a width that is made smaller than that of the other parts thereof.

* * * * *